US006868795B2

(12) United States Patent
Maryamchik et al.

(10) Patent No.: US 6,868,795 B2
(45) Date of Patent: Mar. 22, 2005

(54) BUBBLE CAP ASSEMBLY

(75) Inventors: Mikhail Maryamchik, Copley Township, Summit County, OH (US); Gary L. Anderson, Ducansville, PA (US); Jeffrey J. Hahn, Ebensburg, PA (US); Edwin L. Collins, III, Albany, NY (US); David J. Walker, Wadsworth, OH (US); Jeffrey J. Bolebruch, Gloversville, NY (US)

(73) Assignees: The Babcock & Wilcox Company, New Orleans, LA (US); Blasch Precision Ceramics, Inc., Albany, NY (US)

( * ) Notice: Subject to any disclaimer, the term of this patent is extended or adjusted under 35 U.S.C. 154(b) by 0 days.

(21) Appl. No.: 10/447,895

(22) Filed: May 29, 2003

(65) Prior Publication Data

US 2004/0237858 A1 Dec. 2, 2004

(51) Int. Cl.[7] ..... F23G 5/30; F02M 29/04
(52) U.S. Cl. ..... 110/245; 261/114.2; 34/369
(58) Field of Search ..... 261/114.2; 34/369, 34/249, 360; 110/245; 208/134, 163

(56) References Cited

U.S. PATENT DOCUMENTS 2,301,707 A * 11/1942 Rocke ..... 261/114.2
2,351,855 A 6/1944 Harris
2,494,372 A * 1/1950 Wilson ..... 261/114.2
2,525,064 A * 10/1950 Bragg ..... 261/114.2
4,257,171 A 3/1981 Johnson et al.
4,305,895 A * 12/1981 Heath et al. ..... 261/114.2
4,648,969 A 3/1987 Swanson
5,123,480 A 6/1992 Dixit
5,141,047 A 8/1992 Geoffroy
5,161,471 A 11/1992 Piekos
5,455,011 A 10/1995 Kitto
5,543,117 A 8/1996 Kitto, Jr.
5,632,858 A 5/1997 Kitto, Jr.

FOREIGN PATENT DOCUMENTS

JP 361259748 A * 11/1986 ..... B01J/8/44

OTHER PUBLICATIONS

S. Kavidass, G.L. Anderson & G.S. Norton, Jr., "Why Build a Circulating Fluidized Bed Boiler to Generate Steam and Electric Power" Sep. 20–22, 2000, Pg. 4, Fig. 2, and accompanying text, The Babcock & Wilcox Company.

* cited by examiner

*Primary Examiner*—Kenneth Rinehart
(74) *Attorney, Agent, or Firm*—Eric Marich

(57) ABSTRACT

A bubble cap assembly for use in fluidized bed boilers, furnaces, or reactors, has a bubble cap, a stem, and at least one pin. One end of the stem is inserted into the bubble cap. The bubble cap has outlet holes for delivering a fluidizing medium, typically into a bed of granulated material, but which prevent backsifting of the granulated material into the bubble cap. The bubble cap also has at least one insertion hole, through which a pin may be inserted. When the pin is inserted through the bubble cap insertion hole, it also occupies a groove or indentation on the stem thereby preventing separation or disassembly of the bubble cap and stem combination. An elastic gasket may be provided between the bubble cap and stem to form a fluid tight connection.

21 Claims, 6 Drawing Sheets

BUBBLE CAP ASSEMBLY

FIELD AND BACKGROUND OF THE INVENTION

The present invention relates generally to the field of fuel burning for power and steam generation and, in particular, to a new and useful bubble cap assembly for supplying a fluidizing medium to a fluidized bed.

Circulating Fluid Bed (CFB) technology has found popularity as an attractive way to burn solid fuels to provide steam and power. This popularity is evident both domestically and abroad. In a combustion setting, CFB technology provides good combustion efficiency with low emissions and provides fuel flexibility because it is well suited for burning a wide range of solid fuels such as coal, waste coal, anthracite, lignite, petroleum coke, and agricultural waste. Consequently, it has emerged as an environmentally acceptable technology for utility and industrial applications.

In a circulating fluidized-bed furnace or boiler, the bed material, which normally comprises crushed fuel, limestone and ash, is suspended in the stream of air at about 60–70% of the total amount of the air needed for stoichiometric combustion. The bottom of the bed is supported by water cooled membrane walls with air nozzles which distribute the air uniformly. The fuel and limestone sorbent (for sulfur capture) are fed into the lower bed. In the presence of fluidizing air, the fuel and limestone quickly and uniformly mix under the turbulent environment and behave like a fluid. Carbon particles in the fuel are exposed to the combustion air. The balance of combustion air is introduced at the top of the lower, dense bed as secondary air. This staged combustion limits the formation of nitrogen oxides (NOx).

The bed fluidizing air velocity is greater than the terminal velocity of most of the particles in the bed and thus the fluidizing air elutriates the particles upwardly through the combustion chamber to U-beam separators at the furnace exit. The solids captured by these U-beams, including any unburned carbon and unutilized calcium oxide (CaO), are returned directly back into the combustion chamber without passing through an external recirculation. This internal solids recirculation provides longer residence time for the fuel and limestone, resulting in good combustion and improved sulfur capture.

A fluidized bed apparatus is taught in U.S. Pat. No. 4,648,969 to Swanson, which provides a bed plate for use in controlling the flow of fluid through a fluidized bed in a fluid chamber. The fluidized bed apparatus comprises a fluid chamber having an inlet adjacent the bottom of the chamber and an outlet adjacent the top of the chamber. A bed of particulate material, namely carbon particles, is fluidized with cyanide solution and exits through the outlet, while gold and silver are absorbed by the carbon bed. The bed plate is also provided with a plurality of spaced apart bubble caps which include a vertical passageway extending through the bed plate and deflecting the fluid to be discharged.

U.S. Pat. No. 5,161,471 to Piekos teaches an apparatus for reburning ash material of a previously burned primary fuel. A combustion vessel is disclosed which has an inlet for receiving ash material from a primary combustion unit such as a boiler or a furnace and an outlet for discharging the products of the combustion from the vessel. Combustion air is introduced into the reburn vessel to provide a source of underfire and overfire source of combustion air for the bubbling bed and the upwardly moving components rising out of the bubbling bed.

U.S. Pat. No. 5,141,047 to Geoffrey teaches a fluidized bed heat exchanger that includes vertically extending spaced apart tubes for containing an internal fluid flowing in a heat transfer relationship with the walls of the tube. A containment housing surrounds the tubes and contains a flow of fluidized solid particulates moving through a heat exchange chamber around the exterior of the tubes. Fluidizing gas is directed into the solid particulates via a gas plenum chamber. A bubble cap is provided around each tube for preventing the solid particulates from passing into the plenum chamber while permitting the injected fluidized gas to flow into the heat exchange chamber.

U.S. Pat. Nos. 5,455,011, 5,543,117, and 5,632,858 to Kitto teach a system in which fuel and air are combusted in an injector and mixed with steam to form a combustion product and steam mixture. The mixture is injected into a material bed. The combustion and mixing is separated from the bed material by being confined within the injector. The injector is a bubble cap having at least one hole or an injector made of a ceramic porous material.

Bubble caps are widely used in fluidized bed technology to supply the fluidizing medium, such as fluidizing air, into a fluidized bed. The medium should be evenly distributed over a specified bed area, while preventing the bed particles from backsifting into the fluidizing medium supply source, such as a windbox of a fluidized bed furnace, at all times including those periods when the fluidizing medium supply is shut down.

FIG. 1A illustrates a known distributor plate construction, generally referred to as 100, for a CFB which employs a plurality of bubble cap assemblies 150. Portions of the CFB furnace or combustor walls are omitted for clarity; however, a rear furnace wall 105 and side furnace wall 110, advantageously made of fluid-cooled tubes, are shown. The distributor plate 100 is also comprised of fluid-cooled tubes 115 which convey a working fluid, typically a water or water-steam mixture, from an inlet header 120 to the furnace walls. The horizontal tubes 125 forming the distributor plate 100 are spaced from one another but interconnected by steel membrane through which a plurality of apertures are provided. Beneath the tubes 125 is a plenum region 130. The bubble cap assemblies 150 are connected to the aforementioned apertures in the distributor plate 100 and deliver a gaseous fluid under pressure provided into the plenum or windbox region 130 into the bed of granular material (not shown) provided onto the upper portion of the distributor plate 130 to fluidize the granular material and create the fluidized bed in the fluidized bed region 140.

A typical bubble cap assembly 150 is illustrated in FIG. 1B. As shown, each of these known bubble cap assemblies 150 is comprised of a bubble cap proper 155, and a supply pipe 160, typically referred to as the stem 160, which fluidically interconnects the windbox region 130 with the fluidized bed region 140. Fluidizing gas is conveyed upwardly along the stem 160 into the bubble cap 155, from which it is distributed to the fluidized bed via plural outlet holes 165. Jets of fluidizing gas exiting from the outlet holes 165 penetrate into the bed providing its fluidization in the area around each the bubble cap 155. The outlet holes 165 are provided so as to direct the exiting jets of fluidizing gas downwardly toward the distributor plate 100. This feature (along with the outlet hole configuration, i.e. a specified minimum length over diameter ratio) assures that no backsifting occurs when the fluidizing gas supply is shut down and the bed of granular material collapses onto the distributor plate 100.

In order to provide even distribution and good mixing of the fluidizing air in the bed, the air jet velocity from the outlet holes 165 may be close to or even exceed 200 ft/sec. Combined with the often erosive nature of the bed particles, this may result in substantial rates of wear of the bubble caps 155. For a CFB furnace, both the bubble caps 155 and the stems 160 are typically made of stainless steel to withstand bed temperatures of about 1600° F. when the fluidizing medium is shut down and the bubble cap assembly 150 temperature approaches that of the bed material. Periodic replacement of worn stainless steel bubble caps may present a substantial maintenance expense for such a CFB unit.

An improved, reduced maintenance bubble cap assembly which would overcome these and other problems would thus be welcomed by the industry.

SUMMARY OF THE INVENTION

Ceramics can withstand typical CFB furnace temperatures. In addition, ceramics are much more wear resistant than stainless steel and yet the cost of a ceramic bubble cap is comparable to that of the stainless steel one. Therefore, making bubble caps of ceramics may reduce their overall (capital plus maintenance) cost. However, a ceramic bubble cap cannot be welded to a stainless steel stem, which is the preferred method of assembly when both elements are made of stainless steel. Further, ceramic and steel materials have different coefficients of thermal expansion, stainless steel typically having a higher coefficient of thermal expansion than that of ceramic materials, precluding the use of a threaded approach for assembling the two types of materials together.

Accordingly, one aspect of the present invention is drawn to an improved bubble cap assembly suitable for use in both CFB and bubbling fluidized bed environments comprised of a combination of elements, in which the element subjected to high erosion potential caused by fluidized bed particles is resistant to erosion, and the entire assembly is able to withstand the high temperature environment of a fluidized bed.

Another aspect of the present invention is to provide a bubble cap assembly which is fluid tight, flexibly adaptable to thermal expansion, and more cost effective than an entirely stainless steel bubble cap assembly.

Accordingly, a ceramic bubble cap assembly is provided comprising a ceramic bubble cap connected to a stainless steel stem, both of which are heat resistant to the high temperatures of the typical furnace environment and wherein the bubble cap is also resistant to the erosion. Although the combination of the ceramic bubble cap and stainless steel stem introduces differential thermal expansion effects, the method of connection of the steel stem to the ceramic bubble cap minimizes gaseous fluid leakage between the cap and stem so that the combination is not rendered ineffective. A heat resistant pin, such as a spring or roll pin, inserted into a hole of the bubble cap substantially perpendicular to the axis of the stem, engages a groove or indentation provided on the stem and prevents disassembly of the bubble cap from the stem.

If desired, air leakage between the bubble cap and the stem can be reduced still further by providing an elastic gasket between the bubble cap and the stem.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which a preferred embodiment of the invention is illustrated.

DESCRIPTION OF THE PREFERRED EMBODIMENTS

Figure 1B:
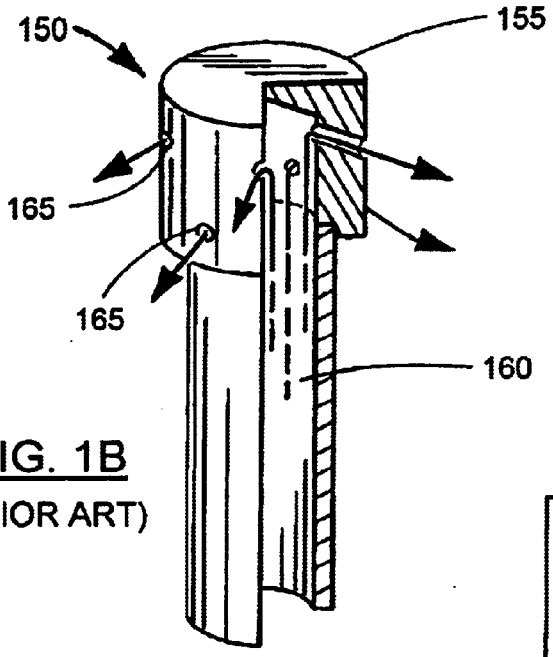
FIG. 1B (PRIOR ART)
FIG. 1B is an enlarged perspective view, partly in section, of a typical prior art bubble cap assembly as used in the distributor plate construction of FIG. 1A.
Figure 1A:
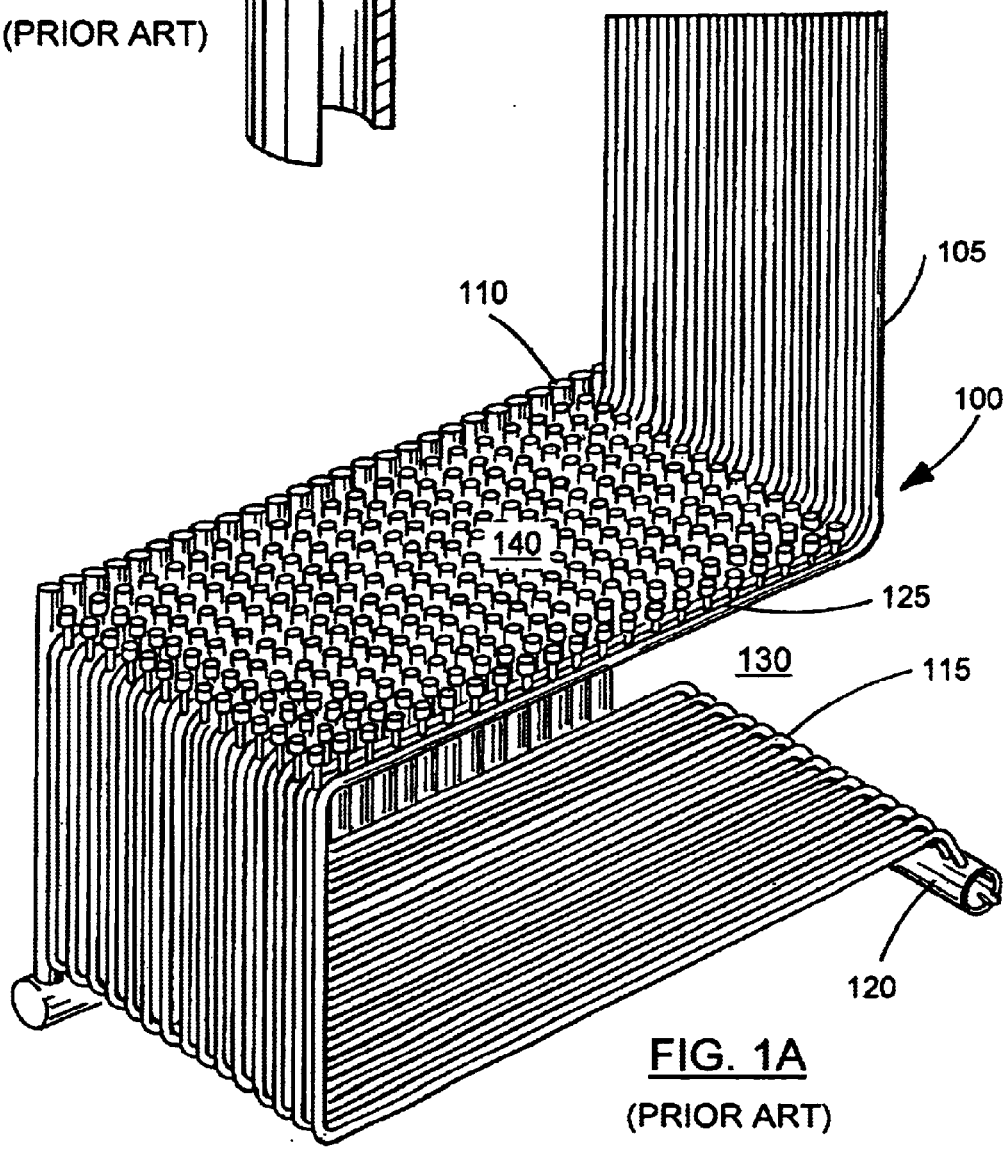
FIG. 1A (PRIOR ART)
FIG. 1A is a perspective view of a known distributor plate construction for a fluidized bed which employs a plurality of bubble cap assemblies.
Figure 2A:
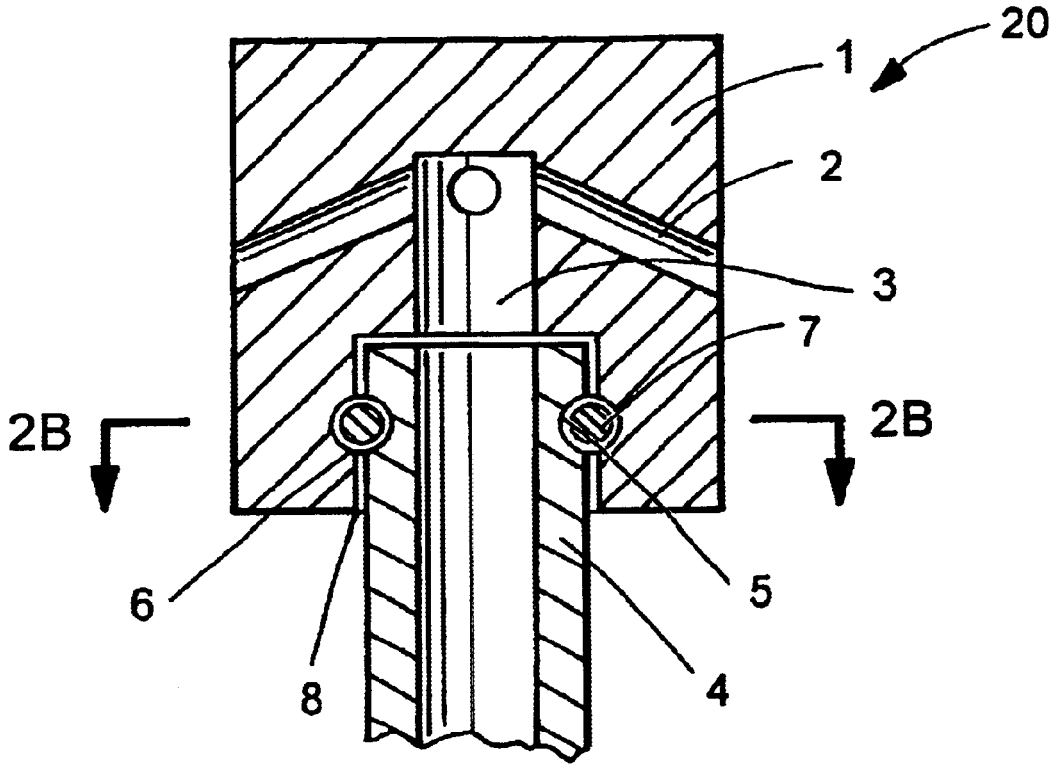
FIG. 2A is a sectional side view of a first embodiment of the bubble cap assembly according to the present invention.
Figure 2B:
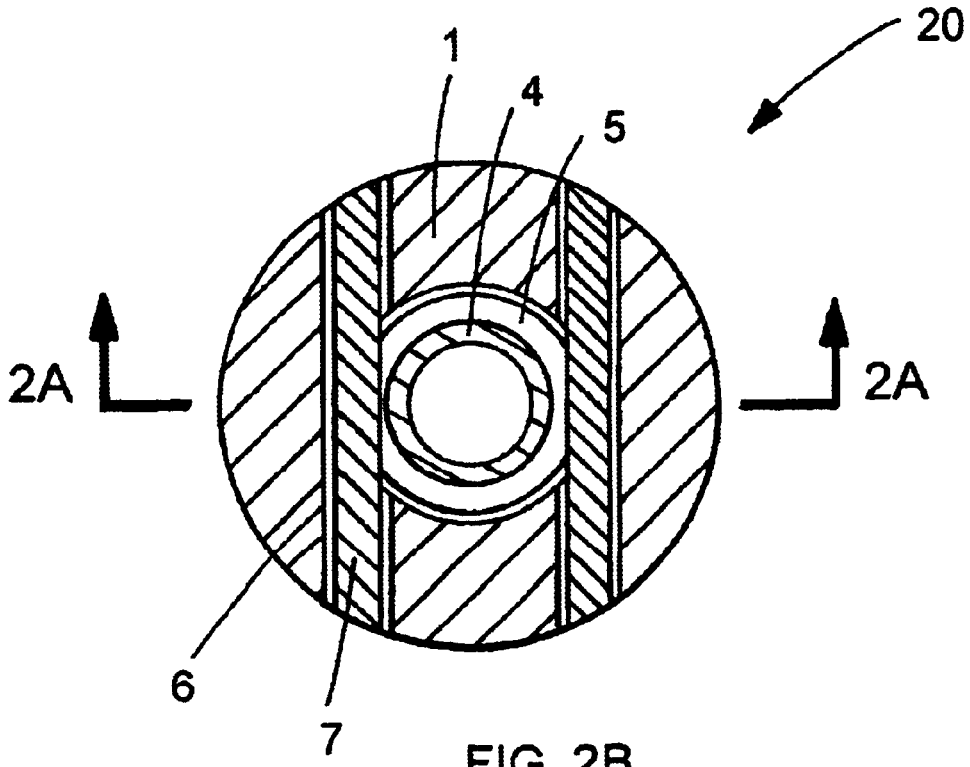
FIG. 2B is a plan sectional view of the bubble cap assembly illustrated in FIG. 2A, viewed in the direction of arrows 2B—2B of FIG. 2A.

In the several drawings comprising the present disclosure, like reference numerals designate the same or functionally similar elements throughout the drawings. A preferred embodiment of the bubble cap assembly according to the present invention and generally designated 20, is shown in FIGS. 2A and 2B. The bubble cap assembly 20 is comprised of a ceramic bubble cap 1 which contains several outlet holes 2 connected through a central air passage 3 to a stainless steel stem 4. One end of the stem 4 is inserted into the bubble cap 1, while the other end (not shown) is connected to a source of fluidizing medium, such as air or other gaseous fluids. The end of the stem 4 which is inserted into the bubble cap 1 is provided with a circular groove 5 on its outer surface. In this embodiment, the bubble cap 1 has two insertion holes 6, their axes being substantially perpendicular to the axis of the stem 4, but this orientation is not critical to the practice of the invention. Each insertion hole 6 has a pin 7 inserted into the hole. The pin 7 can be made of any high temperature resistant material, such as stainless steel, ceramic, etc. Each pin 7 engages a part of the circular groove 5 on the stem 4 and thus prevents the bubble cap 1 from becoming disengaged from the stem 4 during operation.

Sizes and tolerances for the inserted end of the stem 4 and the matching surfaces of the bubble cap 1, as well as for the insertion holes 6 and pins 7, are selected in a way that allows for unobstructed thermal expansion of each element while minimizing air leakage through a gap 8 therebetween within a specified percentage of the air flow through the bubble cap assembly 20. The latter is achieved by permitting a net fluid flow area within the cross-sectional area of the gap 8 which does not exceed 10% of the total cross-sectional flow area of the outlet holes 2.

Figure 3:
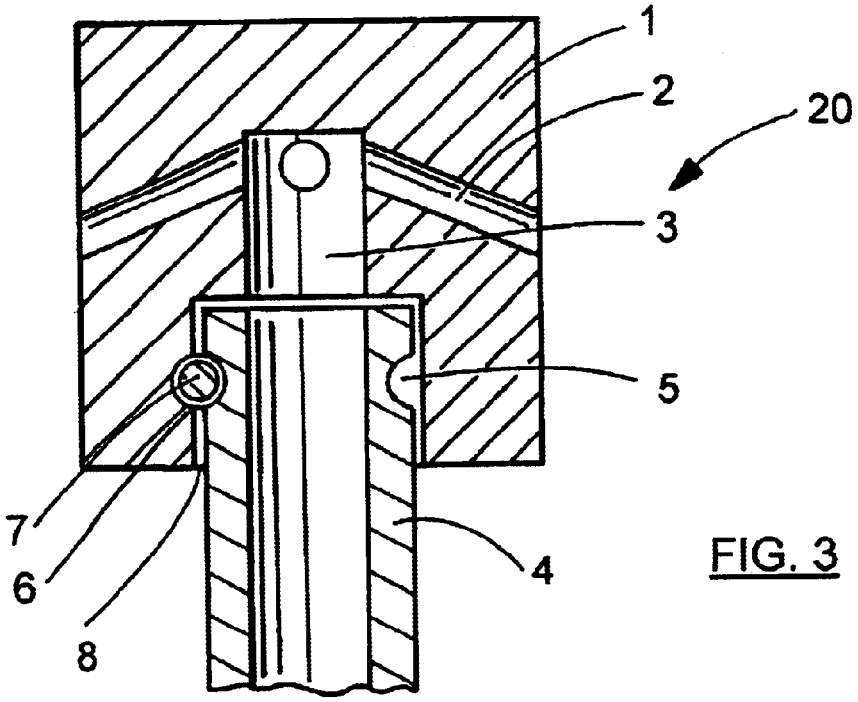
FIG. 3 is a sectional side view similar to that of FIG. 2A showing a second embodiment of the bubble cap assembly according to the present invention, wherein the bubble cap has a single insertion hole.
Figure 4:
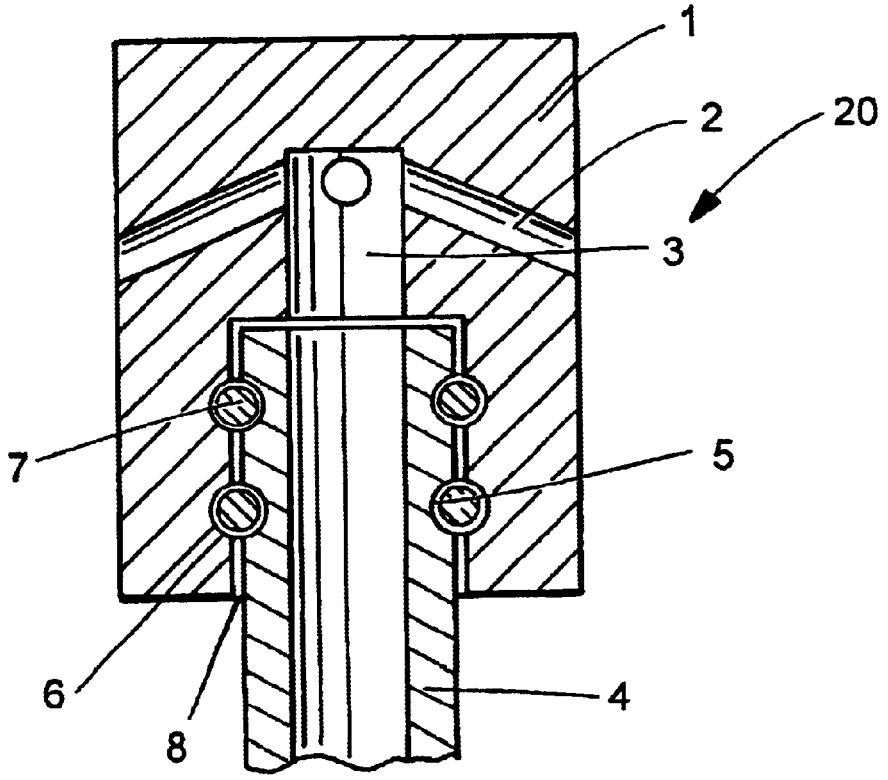
FIG. 4 is a sectional side view similar to that of FIG. 2A showing a third embodiment of the bubble cap assembly according to the present invention, wherein the bubble cap has plural (in this case, four) insertion holes.

As illustrated in FIGS. 3 and 4, in an alternative embodiment of the invention, the number of insertion holes 6, as well as the corresponding number of pins 7 provided in the bubble cap 1, may be varied as necessary. For example, FIGS. 3 and 4 illustrate arrangements with one and four holes 6, respectively.

Figure 5A:
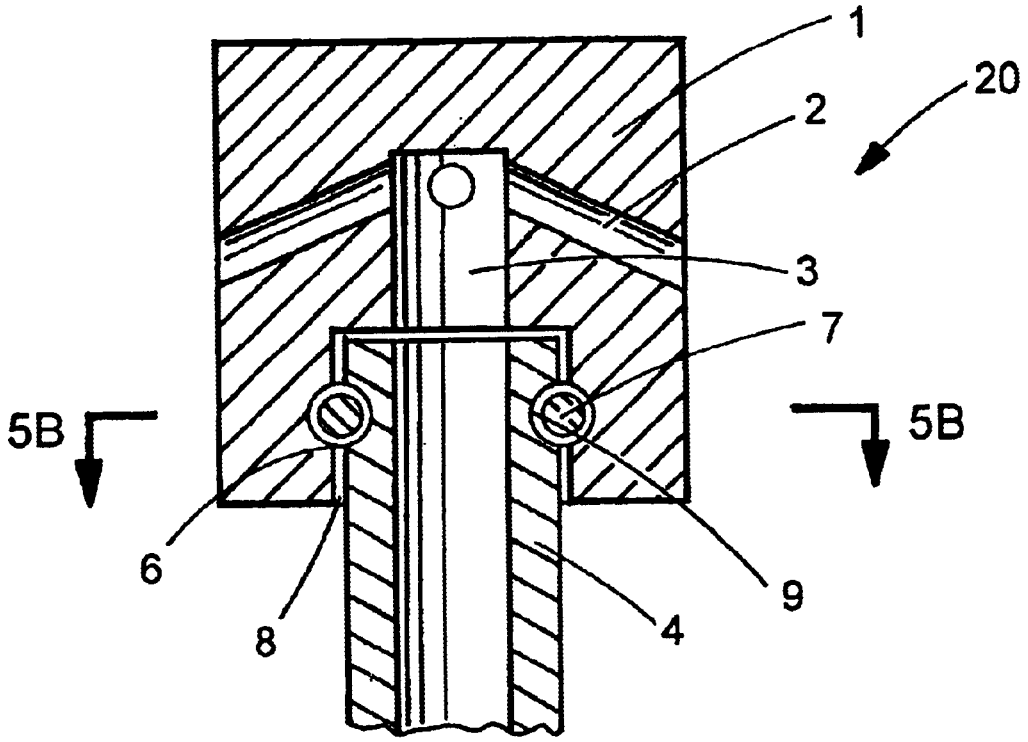
FIG. 5A is a sectional side view similar to that of FIG. 2A showing a fourth embodiment of the bubble cap assembly according to the present invention, wherein the stem is provided with one or more indentations rather than a circular groove.
Figure 5B:
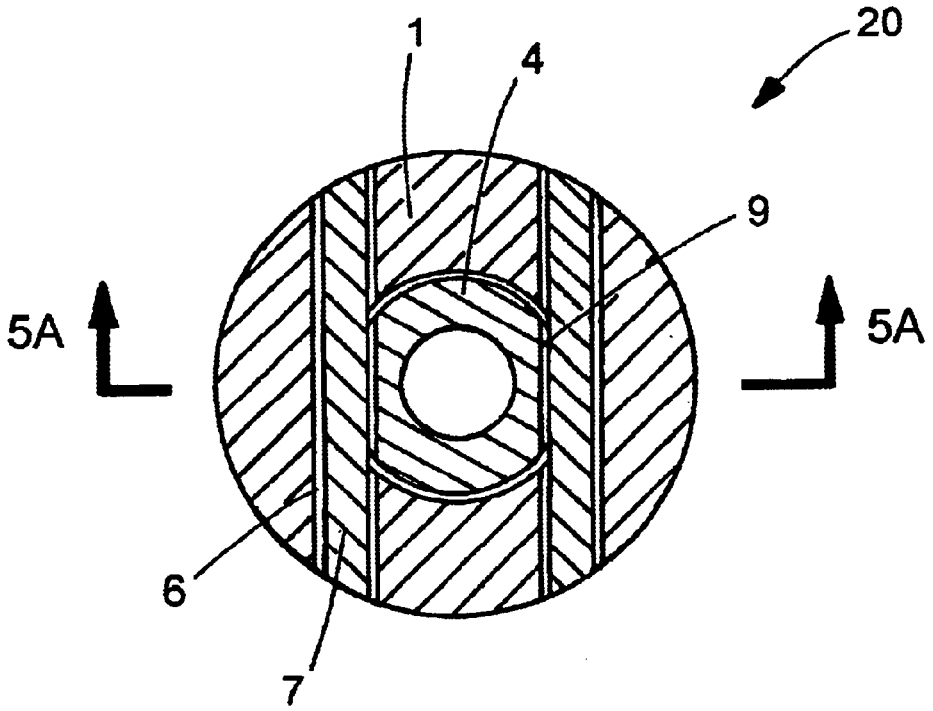
FIG. 5B is a plan sectional view of the bubble cap assembly illustrated in FIG. 5A, viewed in the direction of arrows 5B—5B of FIG. 5A.

As illustrated in FIGS. 5A and 5B, another alternative embodiment of the present invention may utilize indentation(s) 9 on the outer surface of the inserted end of the stem 4, instead of one or more circular groove(s) 5.

The inside diameter portion of the bubble cap 1 receiving the stem 4 is selected based upon the outside diameter of the stem 4 (including any manufacturing tolerances) which is to be received within the bubble cap 1, and the thermal expansion which both the stainless steel stem 4 and the ceramic bubble cap 1 will experience during operation.

Figure 6:
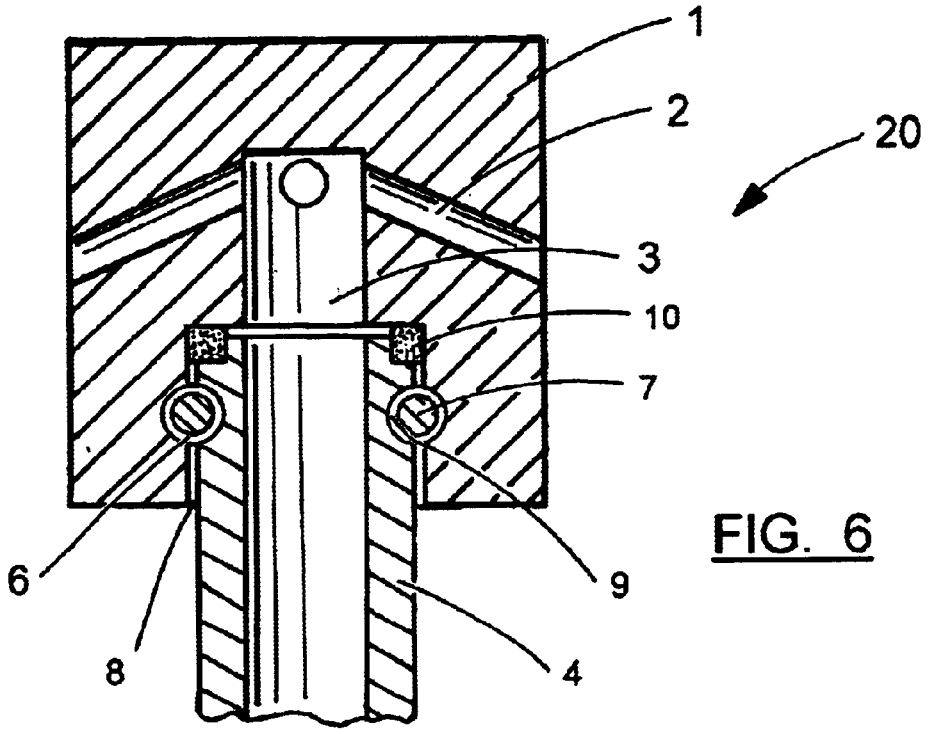
FIG. 6 is a sectional side view similar to that of FIG. 2A showing a fifth embodiment of the bubble cap assembly according to the present invention, wherein an elastic gasket is provided between the stem and the bubble cap.
Figure 7:
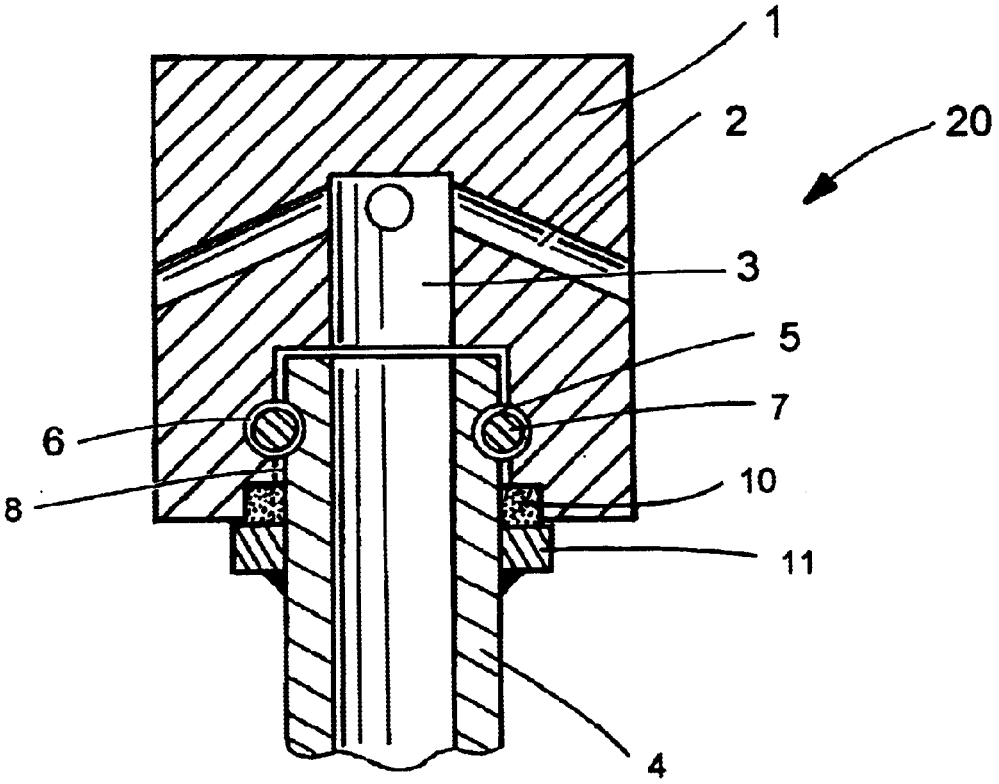
FIG. 7 is a sectional side view similar to that of FIG. 2A showing a sixth embodiment of the bubble cap assembly according to the present invention, illustrating an alternate placement of the elastic gasket provided between the stem and the bubble cap.

FIGS. 6 and 7 disclose other alternative embodiments which permit the tolerances on the inserted end of the stem 4 and matching inside surfaces of the bubble cap 1 which receive the stem 4 to be relaxed. This is accomplished by providing a gasket 10 made of an elastic material suitable for high-temperature applications; one such material is Kaowool®, available from Morgan Thermal Ceramics Inc. of Augusta, Ga. In FIG. 6, the gasket 10 is installed between the stem 4 and bubble cap 1 and will provide a substantially fluid tight connection between these two elements, as shown in FIG. 6. Thus, since the gasket 10 provides the seal, the gasketed approach permits a greater clearance between the stem 4 and the bubble cap 1 to be utilized, thereby further reducing the potential for thermal expansion of the stem 4 possibly causing cracking of the bubble cap 1.

Under certain combinations of bed material size distribution and the CFB unit's mode of operation, the arrangement of FIG. 6 may not be desirable. For example, if the bed material contains fine particles, these fine particles can still fill up the gap 8, at least within the gap 8 up to the point at which the gasket 10 is encountered. Then, when the fluidizing medium is shut down and the bubble cap assembly temperature approaches that of the surrounding bed material, the gap 8 which is filled up with solids will not accommodate the thermal expansion of the stem 4, and cracking of the ceramic bubble cap 1 can occur.

FIG. 7 thus illustrates yet another alternative embodiment which provides for a gasketed bubble cap assembly 20, and which overcomes the particular problem described above in connection with the embodiment of FIG. 6. In this design, the gasket 10 is relocated lower on the stem 4 by providing a ring 11 advantageously welded to the stem 4 and located below the bubble cap 1 when the stem 4 is inserted into the bubble cap 1. This confines the gasket 10 within a recessed portion of the bubble cap 1, and at a location which prevents the granular bed particles from entering the gap 8 at all while still providing the fluid tight connection between the bubble cap 1 and the stem 4. Alternatively, the outside diameter of the stem 4 may be selected or manufactured to provide a lip or step or similar sharp change in outside diameter to confine the gasket 10 to a region between the bubble cap 1 and the stem 4 at that location.

Figure 8A:
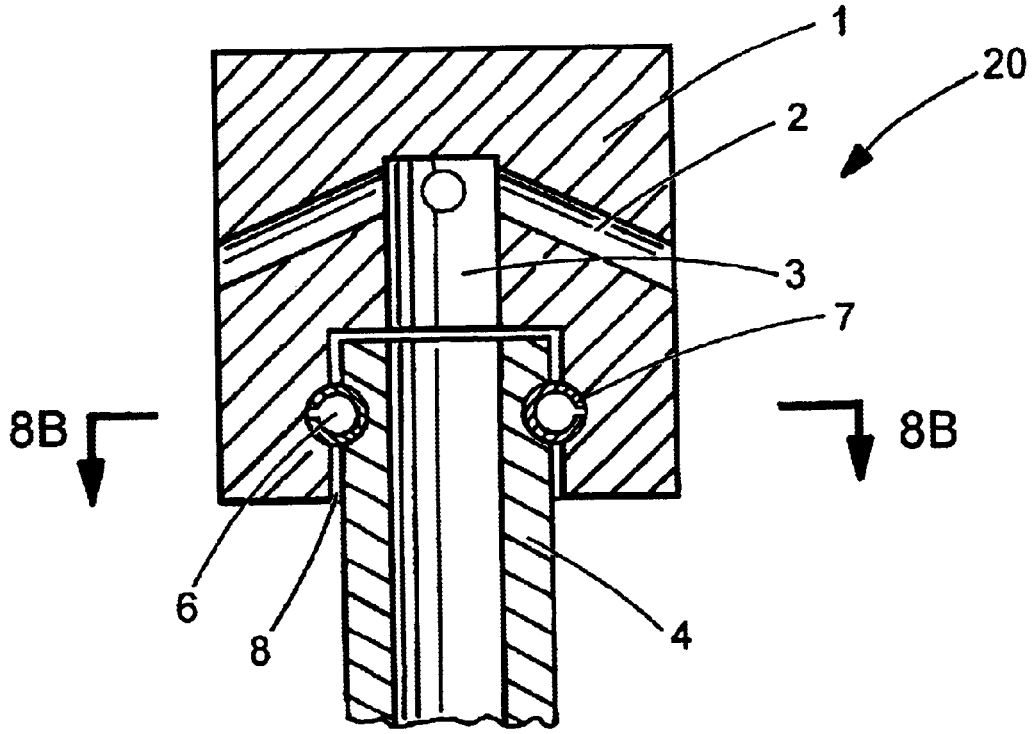
FIG. 8A is a sectional side view similar to that of FIG. 2A showing a seventh embodiment of the bubble cap assembly according to the present invention, wherein a spring or roll pin is utilized to connect the bubble cap to the stem.
Figure 8B:
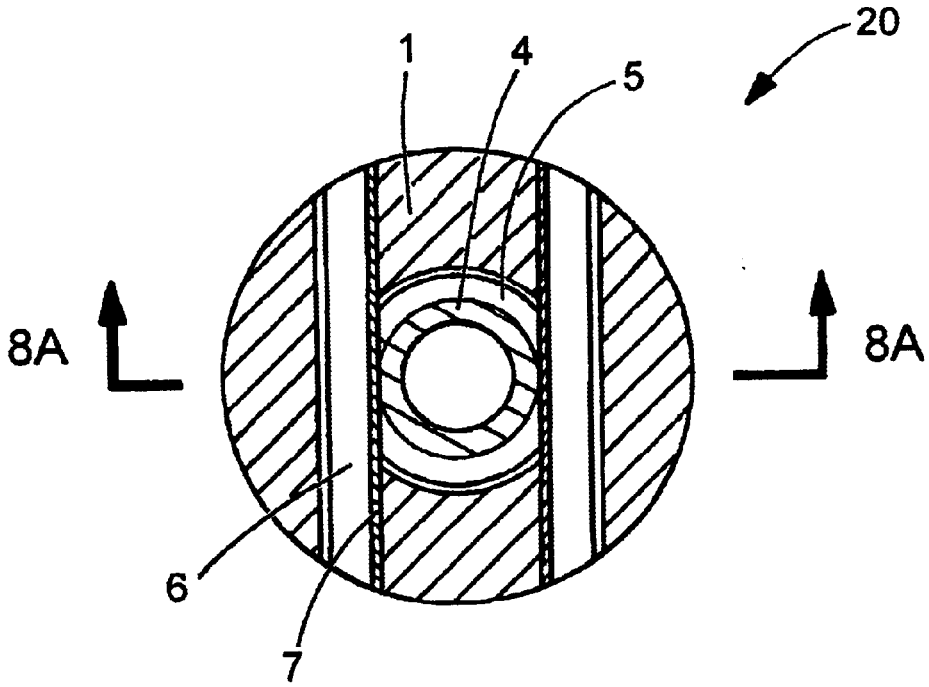
FIG. 8B is a plan sectional view of the bubble cap assembly illustrated in FIG. 8A, viewed in the direction of arrows 8B—8B of FIG. 8A.

Finally, FIGS. 8A and 8B disclose a variation in the structure of the heat resistant pins 7. In this case, the heat resistant pin 7 is not a plain solid cylindrical pin but rather may be comprised of a spring or roll pin 7, which is inserted into the insertion holes 6 of the bubble cap 1 and which engage the circular groove(s) 5 or the indentation(s) 9 on the outer surface of the inserted end of the stem 4. Once again, this construction prevents disassembly of the bubble cap 1 from the stem 4.

The present invention is not limited to bubble cap assemblies 20 employing ceramic bubble caps 1. Other high temperature resistant, as well as wear resistant materials, may be used for making the bubble caps 1. It is also possible that fluidized bed applications other than combustion applications may require the bubble caps 1 to be made of different materials which may be more resistant to certain chemicals, etc. Similarly, the stems 4 may be made of a material other than stainless steel, and the material from which the gasket 10 is made might not need to be made of a high-temperature resistant material.

While specific embodiments of the invention have been shown and described in detail to illustrate the application of the principles of the invention, those skilled in the art will appreciate that changes may be made in the form of the invention covered by the following claims without departing from such principles. Further, while the term "bubble cap assembly" has been used in the foregoing description, that terminology was used solely for convenience and not in any limited sense. It will be appreciated by those skilled in the art that the present invention, in its broadest form, is drawn to a device for supplying fluidizing medium to a fluidized bed; other terms used in the industry for such devices include "pigtails" or "candy canes". Accordingly, the present invention may be applied to new construction involving bubbling or circulating fluidized bed reactors or combustors, or to the replacement, repair or modification of such existing reactors or combustors, and in applications where the devices for supplying fluidizing medium are referred to as "bubble caps" or otherwise. In some embodiments of the invention, certain features may be used to advantage without a corresponding use of the other features. Still further, while the bubble cap assembly according to the present invention has been described as conveying air therethrough as a fluidizing medium, it will be appreciated that the bubble cap assembly may be used to distribute other gaseous fluids which may or may not comprise air or oxygen containing gases. Accordingly, all such changes and embodiments properly fall within the scope of the following claims.

What is claimed is:

1. A bubble cap assembly for supplying a fluidizing medium into a fluidized bed of granulated material, comprising:

a stem having two ends, wherein one end is inserted into a bubble cap with a gap therebetween, the inserted end having at least one of a circular groove and an indentation on its outer surface, the bubble cap having at least one outlet hole for delivering the fluidizing medium into the bed of granulated material and having at least one insertion hole which is adjacent to at least one of the circular groove and the indentation on the stem when the bubble cap receives the inserted end of the stem; and at least one pin inserted into the insertion hole and engaged with at least one of the circular groove and the indentation on the stem for coupling the bubble cap to the stem, sizes and tolerances of the inserted end of the stem, an inside diameter portion of the bubble cap receiving the stem, and of the at least one pin and insertion hole being selected to allow for unobstructed thermal expansion during operation while minimizing fluid leakage through the gap.

2. The bubble cap assembly according to claim 1, wherein the bubble cap is made of a ceramic material.

3. The bubble cap assembly according to claim 1, wherein the pin is a spring pin.

4. The bubble cap assembly according to claim 1, wherein the stem is made of stainless steel material.

5. The bubble cap assembly according to claim 1, wherein a gap between the bubble cap and stem has a net fluid flow area that does not exceed a specified percentage of a total flow area of the at least one outlet hole.

6. The bubble cap assembly according to claim 5, wherein the gap between the bubble cap and stem has a net fluid flow area that does not exceed ten percent of the total flow area of the at least one outlet hole.

7. The bubble cap assembly according to claim 1, further comprising a gasket sealably engaged between the stem and the bubble cap.

8. The bubble cap assembly according to claim 7, wherein the gasket is located within the bubble cap when the stem is inserted into same.

9. The bubble cap assembly according to claim 7, wherein the bubble cap is provided with a recessed portion at a location where the bubble cap receives the stem, and the gasket is sealably engaged between the stem and the bubble cap at the recessed portion when the stem is inserted into the bubble cap.

10. The bubble cap assembly according to claim 9, wherein the stem is provided with means for confining the gasket to the recessed portion when the stem is inserted into the bubble cap.

11. The bubble cap assembly according to claim 7, wherein the gasket is made of an elastic material suitable for high-temperature applications.

12. A bubble cap assembly for supplying a fluidizing medium into a fluidized bed of granulated material, comprising:

a stem having two ends, wherein one end is inserted into a bubble-cap, the inserted end having at least one of a circular groove and an indentation on its outer surface, the bubble cap having at least one outlet hole for delivering the fluidizing medium into the bed of granulated material and having at least one insertion hole which is adjacent to at least one of the circular groove and the indentation on the stem when the bubble cap receives the inserted end of the stem, and a gap between the bubble cap and stem that has a net fluid flow area that does not exceed ten percent of the total flow area of the at least one outlet hole; and at least one pin inserted into the insertion hole and engaged with at least one of the circular groove and the indentation on the stem for coupling the bubble cap to the stem.

13. The bubble cap assembly according to claim 12, wherein the bubble cap is made of a ceramic material.

14. The bubble cap assembly according to claim 12, wherein the pin is a spring pin.

15. The bubble cap assembly according to claim 12, wherein the stem is made of stainless steel material.

16. A bubble cap assembly for supplying a fluidizing medium into a fluidized bed of granulated material, comprising:

a stem having two ends, wherein one end is inserted into a bubble cap, the inserted end having at least one of a circular groove and an indentation on its outer surface, the bubble cap having at least one outlet hole for delivering the fluidizing medium into the bed of granulated material and having at least one insertion hole which is adjacent to at least one of the circular groove and the indentation on the stem when the bubble cap receives the inserted end of the stem, and a gasket made of an elastic material suitable for high-temperature applications sealably engaged between the stem and the bubble cap; and at least one pin inserted into the insertion hole and engaged with at least one of the circular groove and the indentation on the stem for coupling the bubble cap to the stem.

17. The bubble cap assembly according to claim 16, wherein the bubble cap is made of a ceramic material.

18. The bubble cap assembly according to claim 16, wherein the pin is a spring pin.

19. The bubble cap assembly according to claim 16, wherein the stem is made of stainless steel material.

20. The bubble cap assembly according to claim 16, wherein the bubble cap is provided with a recessed portion at a location where the bubble cap receives the stem, and the gasket is sealably engaged between the stem and the bubble cap at the recessed portion when the stem is inserted into the bubble cap.

21. The bubble cap assembly according to claim 16, wherein the stem is provided with means for confining the gasket to the recessed portion when the stem is inserted into the bubble cap.

* * * * *